US005679037A

United States Patent [19]

Rieben

[11] Patent Number: 5,679,037

[45] Date of Patent: Oct. 21, 1997

[54] STATIONARY SCREW INDUCTION SYSTEM

[76] Inventor: Leo R. Rieben, 10419 E. Desmet, Spokane, Wash. 99203

[21] Appl. No.: 609,775

[22] Filed: Mar. 1, 1996

[51] Int. Cl.[6] ..... B63H 1/18

[52] U.S. Cl. ..... 440/66; 415/143; 415/221; 440/38

[58] Field of Search ..... 440/38, 46, 47, 440/66–68; 60/221, 222; 415/143, 221

[56] References Cited

U.S. PATENT DOCUMENTS

| | | | |
|---|---|---|---|
| 185,454 | 12/1876 | Pardey | 440/38 |
| 1,910,216 | 5/1933 | Gill | 440/47 |
| 3,040,696 | 6/1962 | Dahle | 440/46 |
| 3,934,538 | 1/1976 | Canazzi | 115/39 |
| 4,465,430 | 8/1984 | De Montmorency | 415/221 |
| 4,929,200 | 5/1990 | Guezou et al. | 440/38 |
| 4,936,803 | 6/1990 | Burge | 440/66 |
| 5,090,929 | 2/1992 | Rieben | 440/40 |

*Primary Examiner*—Edward L. Swinehart
*Attorney, Agent, or Firm*—Wells, St. John, Roberts, Gregory & Matkin P.S.

[57] ABSTRACT

A stationary screw induction system for improving performance of a watercraft has a cylindrical housing with a first closed end and a second open end. A housing inlet opening is disposed within the housing between the first and second ends. Disposed within the inside of the cylindrical housing is an induction screw which is a helical shaped surface radially disposed about a spine which is coincident with the central axis of the cylindrical housing and forms the central section of the induction screw. The helical shaped surface has a leading edge in contact with the spine and an outside edge in contact with the inner surface of the housing. An induction channel acts to conduct fluid from the surrounding environment into the stationary screw induction system. The induction channel has an induction inlet which acts in fluid communication with the housing inlet opening. An induction inlet shelf is disposed between an edge of the housing inlet opening and the central section of the helical shaped surface at the spine. The induction channel has a first side tangential to the housing and a second side which intersects the induction inlet shelf at the housing inlet opening. The induction channel further has sides disposed between the first and second sides such that the induction channel intersects the housing at an acute angle. The stationary screw system may be further provided with an internal impeller or propeller to provide a motive source.

14 Claims, 12 Drawing Sheets

STATIONARY SCREW INDUCTION SYSTEM

TECHNICAL FIELD

This invention pertains to apparatus for improving the performance of watercraft, in particular to a stationary screw induction system.

BACKGROUND OF THE INVENTION

Methods and apparatus for powering watercraft are traditionally inefficient due to the inherent nature of trying to generate a reactive force against a liquid such as water. Much energy is lost as a result of turbulence, cavitation, backflow, and other fluid dynamic phenomena. Small gains in efficiency of watercraft propulsion methods may yield large benefits in fuel savings. Much time and effort has been directed towards optimizing the shape and design of propeller blades, as well as impellers in jet propulsion systems. These efforts are directed primarily towards preventing inefficient flow patterns. Other efforts have been directed towards removing inefficiencies generated by the drive system. For example, Volvo Penta teaches the method of using two propeller blades in counter rotational orientation. While these efforts have produced beneficial results, a large percent of energy is still wasted due to the inherent design of known watercraft propulsion systems.

It is therefore an object of this invention to provide an apparatus for improving the performance and efficiency of a watercraft.

BRIEF DESCRIPTION OF THE DRAWINGS

Preferred embodiments of the invention are described below with reference to the following accompanying drawings.

FIG. 4 is a bottom view of the apparatus of FIG. 2.

FIG. 5 is a right side view of the apparatus of FIG. 2.

FIG. 10 is an end view of an alternate embodiment of the invention.

FIG. 12 is an alternate environmental view of the present invention.

FIG. 13 is an isometric view of an alternate embodiment of the present invention showing the modified inlet channel.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The present invention describes a stationary screw induction system which is useful for improving the efficiency and performance of a watercraft. The stationary screw induction system includes an elongated housing which is preferably a cylindrical shape. A first end of the housing is closed to prevent the movement of fluid therethrough. The second end of the housing, which typically would be positioned near the stern of the watercraft to which the apparatus would be mounted, is open to permit the discharge of fluid therefrom. The housing has a central axis spanning the first and second ends of the housing. Disposed within the side of the housing is a housing inlet opening to permit the entry of fluid into the apparatus. The inlet opening has at least one defined edge thereto. Positioned within the housing is an induction screw which is an essentially helical shaped surface radially disposed about the central axis of the housing. The helical shaped surface has a leading edge at one end of the helix and a trailing edge at the other end, being the end nearest the second, or open, end of the housing. The leading edge of the helical surface is in contact with the defined edge of the housing inlet opening, thusly allowing the helical surface to be in fluid communication with the housing inlet opening. The outside edge of the helical surface is in contact with the inner surface of the housing. The stationary screw induction system further includes an induction channel which is in fluid communication at a first end with the housing inlet opening. Fluid enters the induction channel through an induction inlet at the opposite end of the induction channel and is conducted onto the helical surface through the housing inlet opening. As a result of the shape of the helical surface a swirling motion is imparted to the fluid, which then exits the housing through the open end of the housing.

Figure 1:
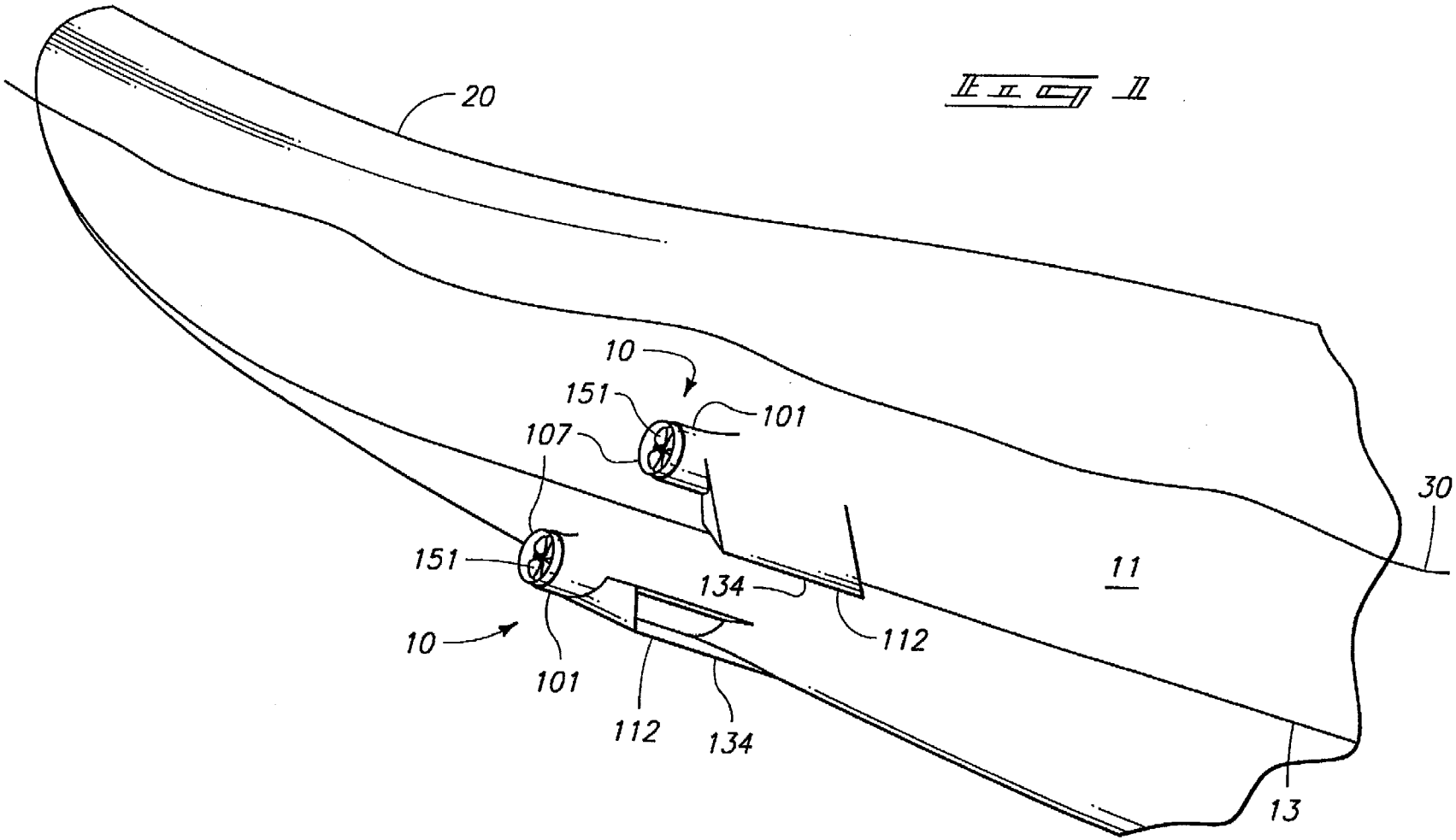
FIG. 1 is a drawing of a watercraft showing the present invention attached thereto.

Referring now to the drawings, FIG. 1 shows a watercraft 20 having the apparatus of the present invention installed thereon. Two stationary screw induction systems, indicated generally as 10, are shown mounted on the watercraft in FIG. 1, one induction system mounted to the hull on either side of the watercraft 20. The stationary screw induction systems are mounted such that the induction inlet 112 is always submerged below the water line 30. Further description of the operation of present invention when mounted on a watercraft is provided in the expanded description below.

Figure 2:
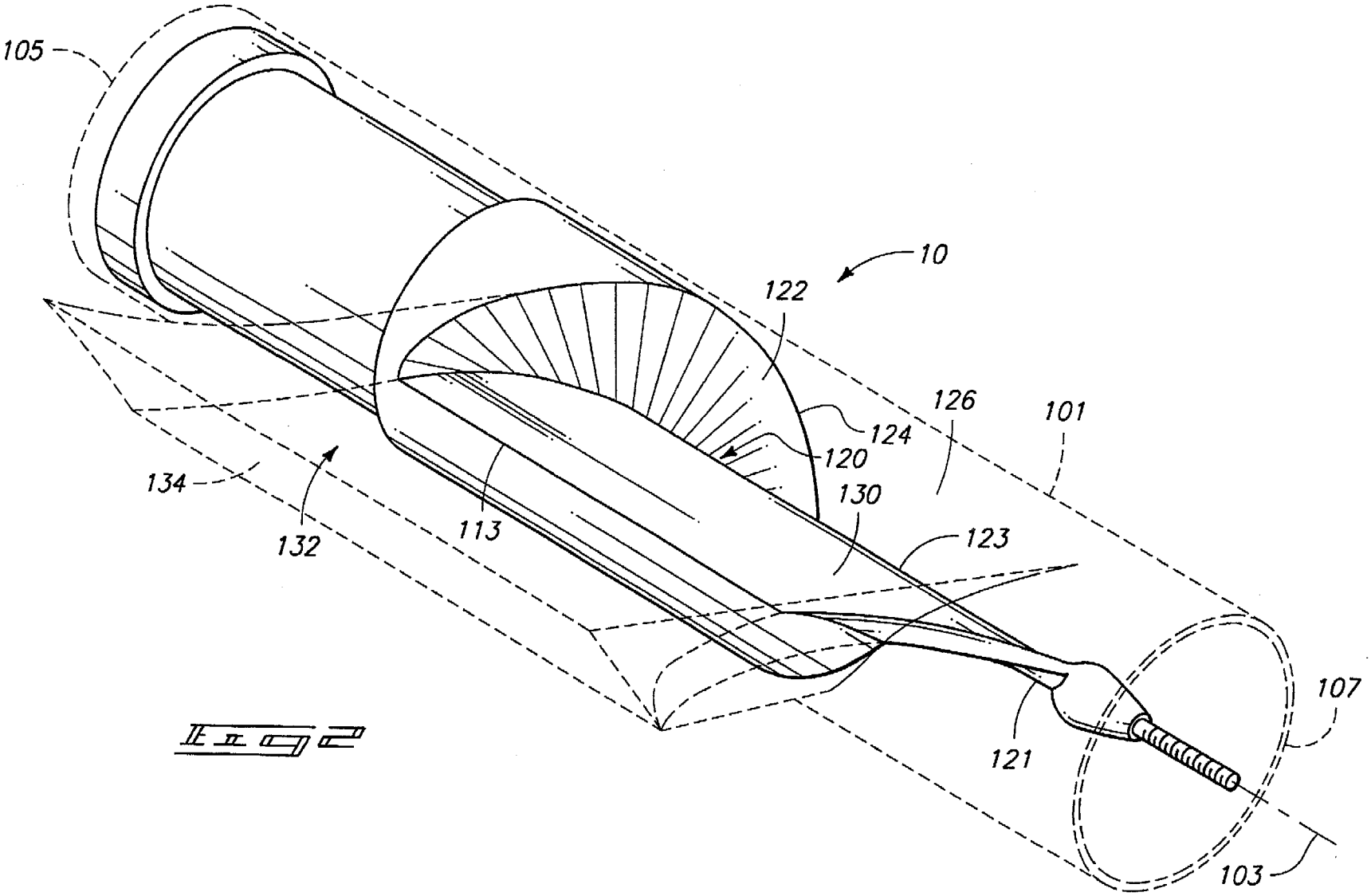
FIG. 2 is an isometric drawing of the preferred embodiment of the present invention.

FIG. 2 is an isometric drawing of the preferred embodiment of the stationary screw induction system 10 shown in FIG. 1. The stationary screw induction system 10 of FIG. 2 has a cylindrical housing 101 having a central axis 103. The first end 105 of the housing is closed to prevent movement of fluid therethrough. The second end 107 of the housing is open to permit the discharge of fluid therethrough. Disposed within the housing between the first and second ends is a housing inlet opening 109 as shown in FIG. 5. In the preferred embodiment the housing inlet opening has two edges 113 and 114 which are parallel to one another and are also parallel with the central axis 103. Coincident with the central axis 103 of the housing is a rigid spine 121 which is used to provide structural stability to additional internal components described below. Disposed within the cylindrical housing is an induction screw 120 which comprises a helical shaped surface 122 which is radially disposed about the spine 121. The central section 123 of the helical surface is essentially wrapped about spine 121 over the length of the inducing screw 120. The outside edge 124 of the helical surface 122 is in contact with the inner surface 126 of the housing. The helical surface central section 123 is in contact with an induction inlet shelf 130. As further shown in FIG. 5, the induction inlet shelf is disposed between the essentially straight edge 113 of the inlet opening 109 and the helical surface central section 123 to create a flow conduit between the inlet housing opening 109 and the helical shaped surface 122. The inlet shelf 130 forms an essentially flat surface between the edge 113 and the spine 121. Fluid may thereby be conducted from the inlet opening 109 into the induction screw 120. The invention further includes an induction channel 132 for conducting fluid into the housing inlet opening 109. Fluid enters the induction channel through the induction inlet 134.

In addition to providing a flow conduit between the inlet opening edge 113 and the central section 123, the induction shelf also acts to provide support and stability to the induction screw 120, within the housing 101. Likewise, while the central section acts as the central axis for the helical surface 122, it also acts to support a drive shaft, more fully described below.

The pitch of the helical surface 122 does not need to be constant, and may be progressive (i.e., pitch increases as the helix approaches end 107), or regressive (i.e., pitch decreases as the helix approaches end 107). Further, while in the preferred embodiment the housing is a regular cylinder having a constant diameter, an irregular cylinder may be used having either a taper or an expansive section, or a combination thereof, along the length of the housing.

Although in the preferred embodiment, the stationary screw induction system is described as having a spine 121, it is possible to construct an operational apparatus having a central section 123 without spine 121. Such an embodiment would be useful where no central drive shaft (described below) is used, and where the induction screw 120 is sufficiently rigid and attached to the inner surface 126 of housing 101.

Turning to FIG. 4 it can be seen that the induction inlet 134 is essentially a quadrilateral framed by a first side 136, a second side 138, a third side 140, and a fourth side 142. In the preferred embodiment the edges of the induction inlet 134 formed by the first side 136 and the second side 138 are essentially parallel. Induction channel second side 138 is preferentially tangential to housing 101 as shown in FIG. 5, while induction channel first side 136 is in contact with the essentially straight edge of housing inlet opening 109. While induction channel first side 136 and second side 138 may be parallel to one another, in the preferred embodiment the sides converge with respect to their proximity to housing 101. It can be seen that the induction channel first side 136 and the induction inlet shelf 130 intersect along the essentially straight edge 113 of the housing inlet opening 109. In the preferred embodiment the first side 136 of the induction channel and the induction inlet shelf 130 lie in essentially the same plane. However, in an alternate embodiment of the invention, induction channel first side 136 and induction inlet shelf 130 may lie in different planes intersecting at the essentially straight edge 113.

Figure 3:
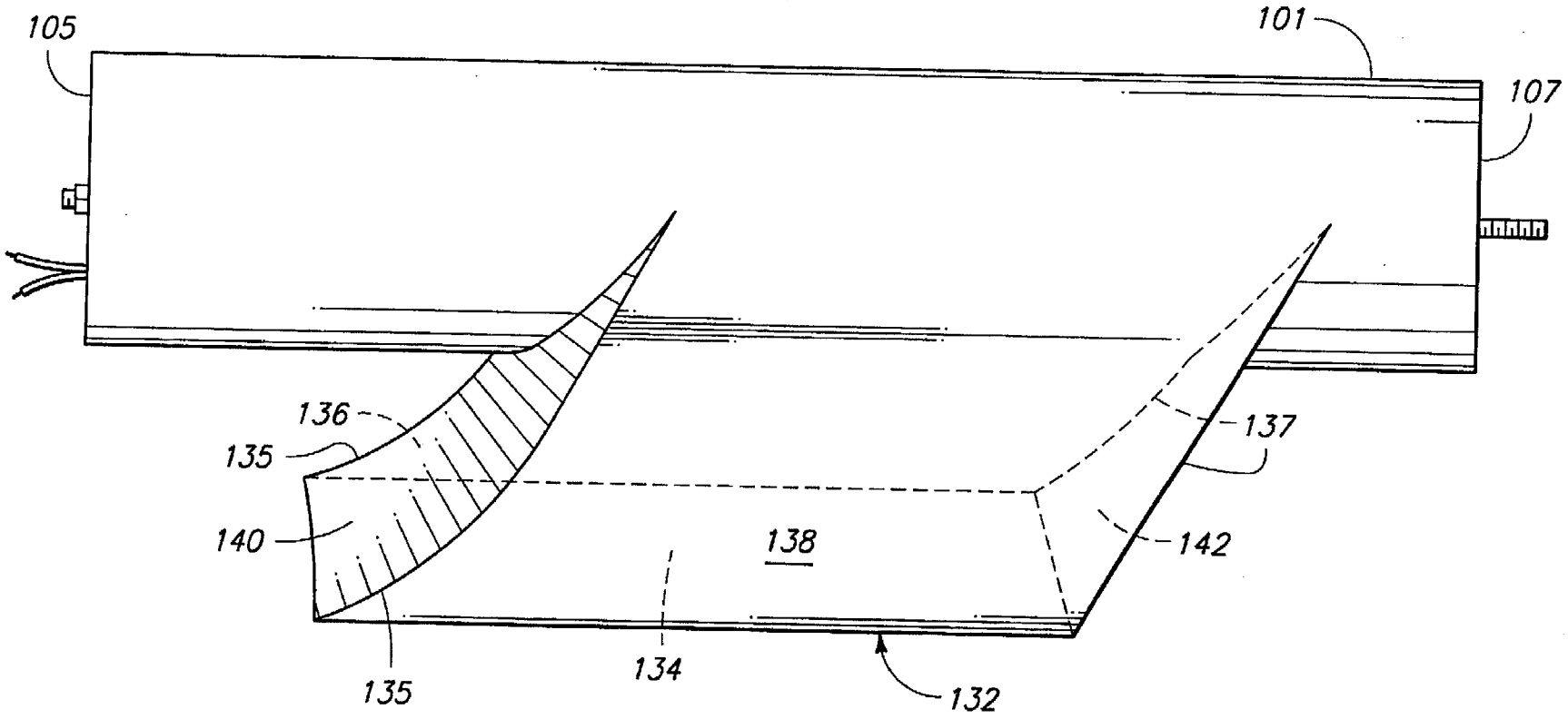
FIG. 3 is a top view of the apparatus of FIG. 2.

Turning now to FIG. 3 which is a top view of the screw induction system of the present invention, it is seen that the first and second sides 136 and 138 respectively of the induction channel 132 each have a leading edge 135 approximate to the first end 105 of housing 101, and a trailing edge 137 approximate to the second end 107 of housing 101. Disposed between the leading edges of first and second side of induction channel 132 is the third side 140 of the induction channel. Disposed between the trailing edges 137 is fourth side 142 of the induction channel. Induction channel third side 140 and fourth side 142 intersect the housing 101 at an angle such that as the third and fourth sides become distal from the housing, the sides also slant away from the second end 107 of housing and toward the first end 105. Induction channel third and fourth sides 140 and 142 respectively preferably intersect housing 101 at an angle acute to a line perpendicular to the housing. In the preferred embodiment the third side 140 of the induction channel is not parallel to the fourth side 142 but instead curves away from the fourth side as the third side becomes distal from the housing 101. Additionally, the third side 140 curves away from the fourth side 142 at a faster rate proximate to the induction channel first side 136 than it does proximate to the induction channel second side 138. This particular geometry of the induction inlet 134 and the induction channel 132 causes water entering the induction channel proximate to the first side 136 to enter at a different angle than the water entering proximate to the second side 138. Water entering the induction inlet 134 proximate to the first side 136 enters at an angle closer to parallel to the central axis 103 than does water entering proximate to the second side 138. This difference of angles of water entering the induction inlet imputes a swirling motion to the water which is then enhanced further by the helical shaped surface 122. The geometry of the induction inlet 134 is further shown in FIG. 5 which is a right side view of the apparatus of the invention. Although not shown, fins may be fitted within the induction channel to further channel the incoming water into the desired swirling motion and reduce turbulence within the induction channel.

When used in lakes and other areas where aquatic vegetation may be encountered, it may be desirable to place a screen over inlet opening 134. Alternately, the outside edge 179 of induction channel 132, shown in FIG. 8, may be very sharp to act as a weed cutter for aquatic vegetation, thus reducing plugging and fouling.

Figure 7:
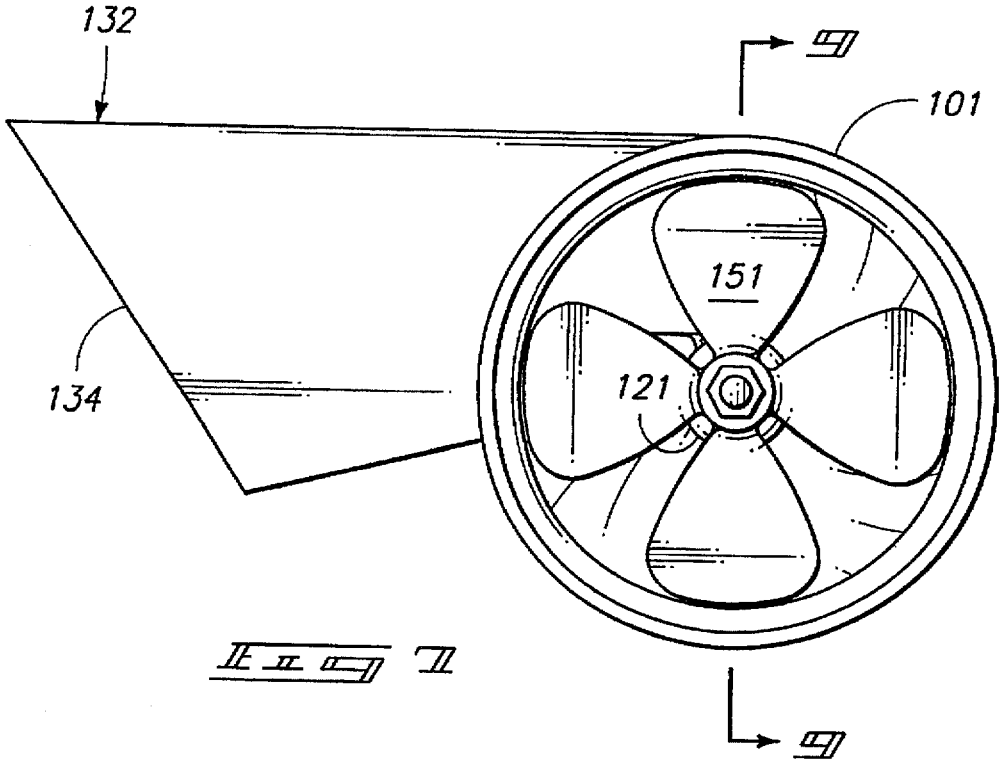
FIG. 7 is a rear view of an alternate embodiment of the apparatus of FIG. 2.
Figure 9:
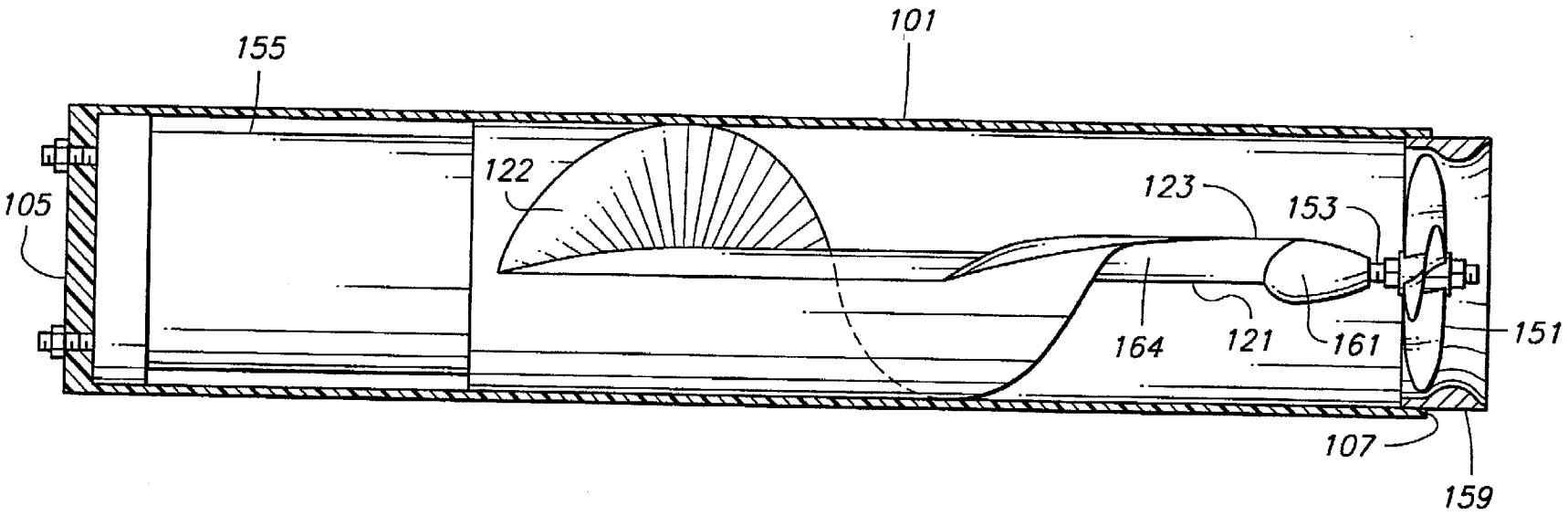
FIG. 9 is a right side sectional view of the figure shown in FIG. 5.
Figure 11:
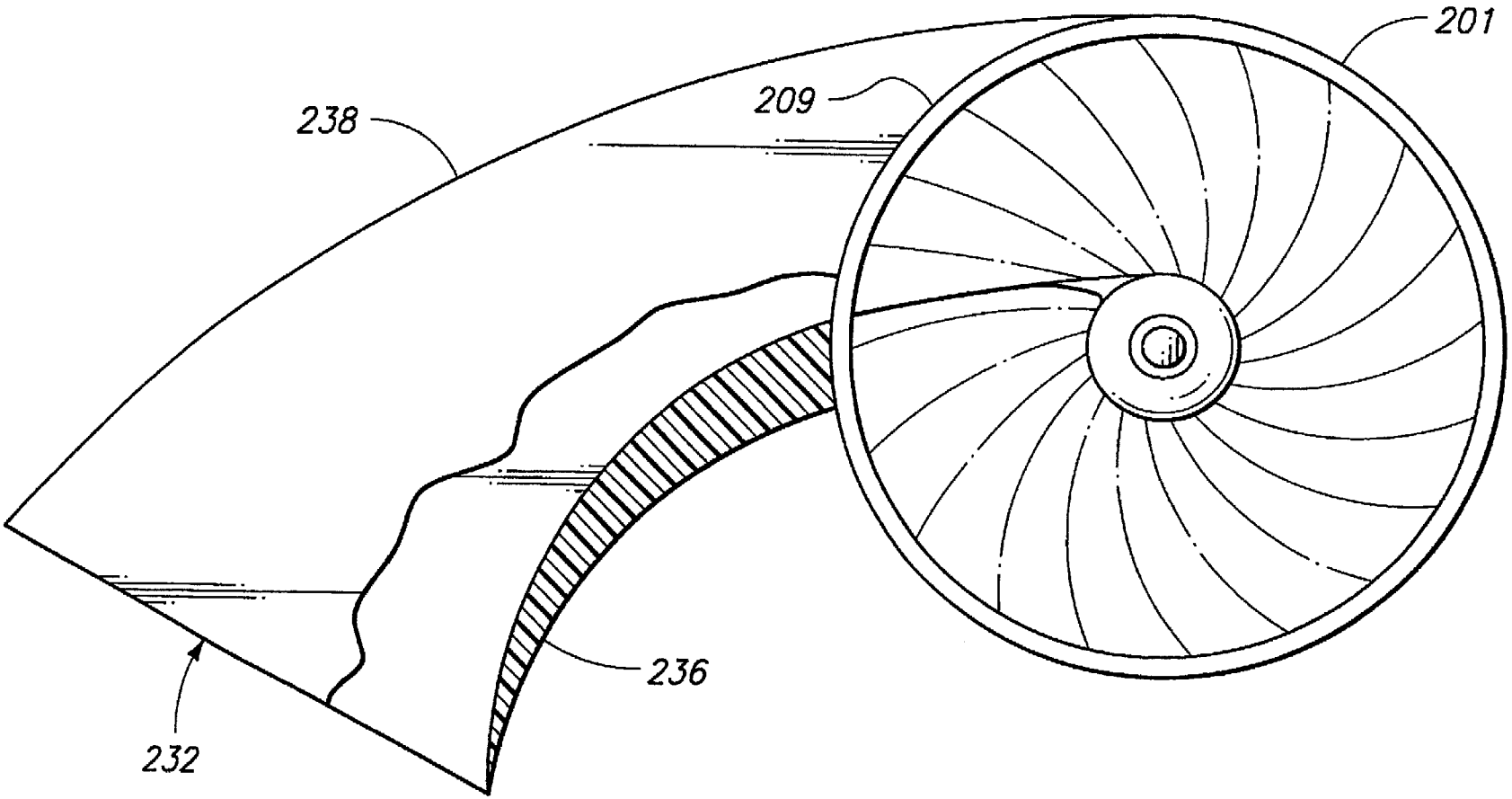
Figure 11:
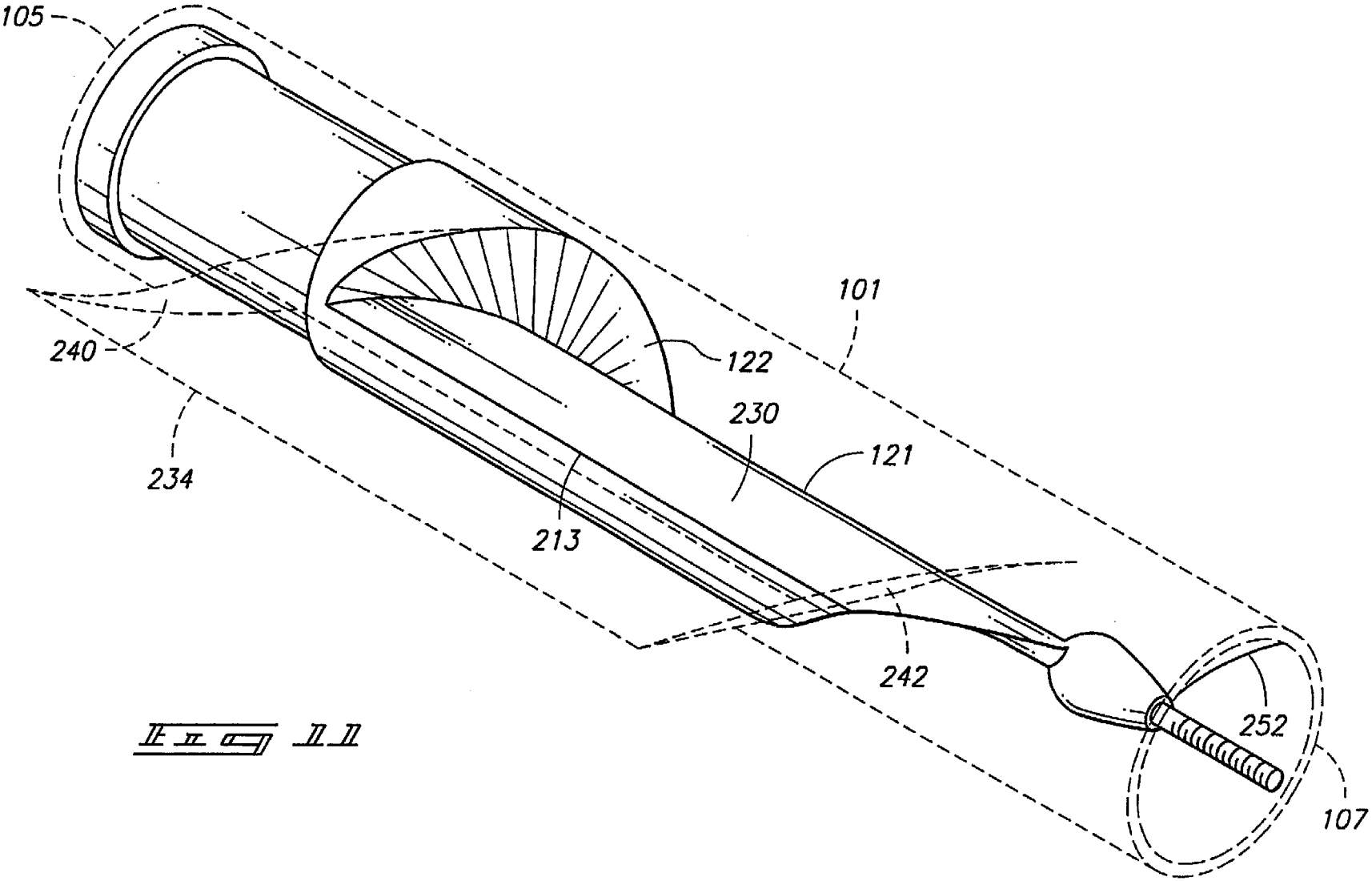
Figure 11:
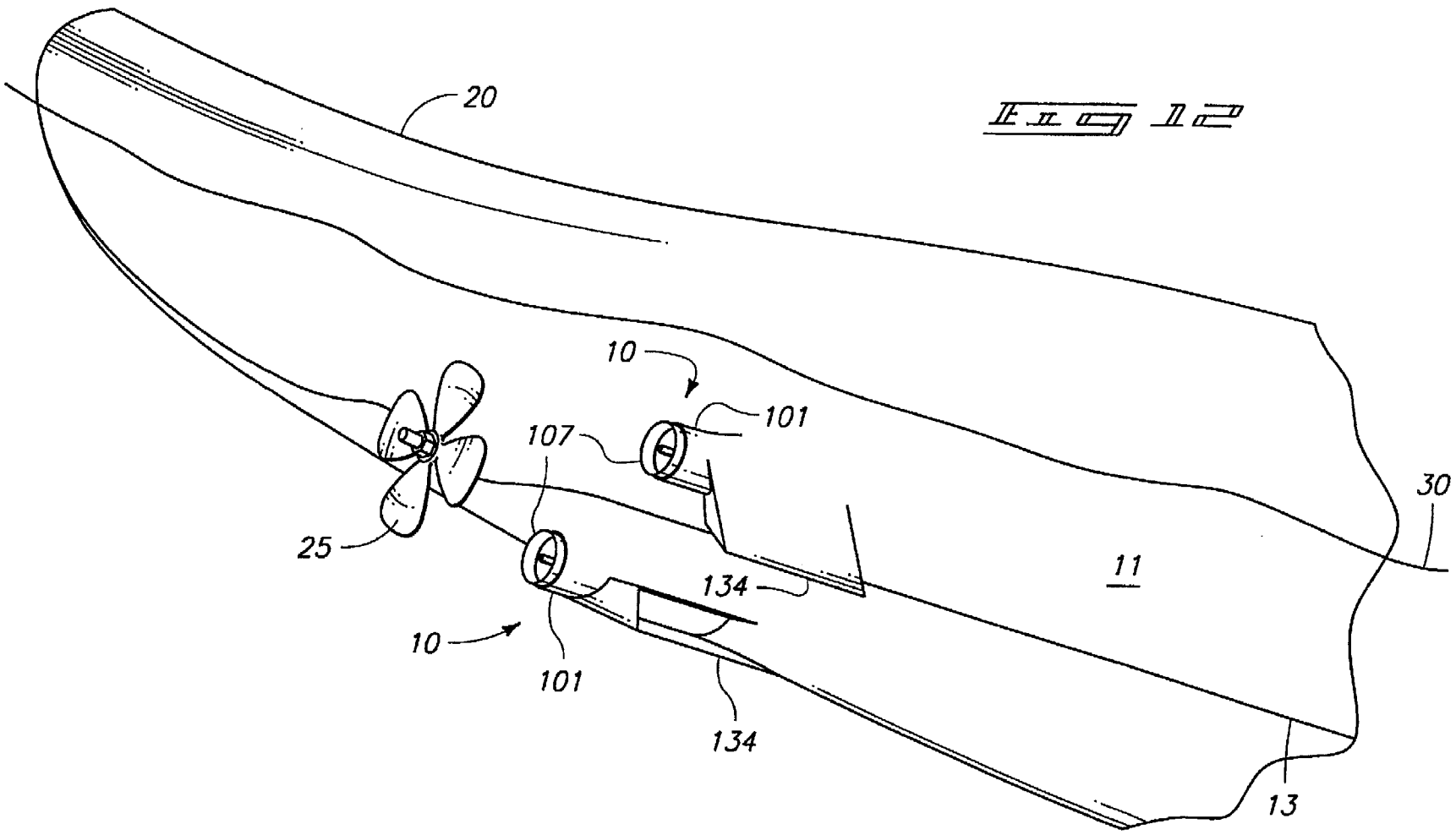
Figure 11:
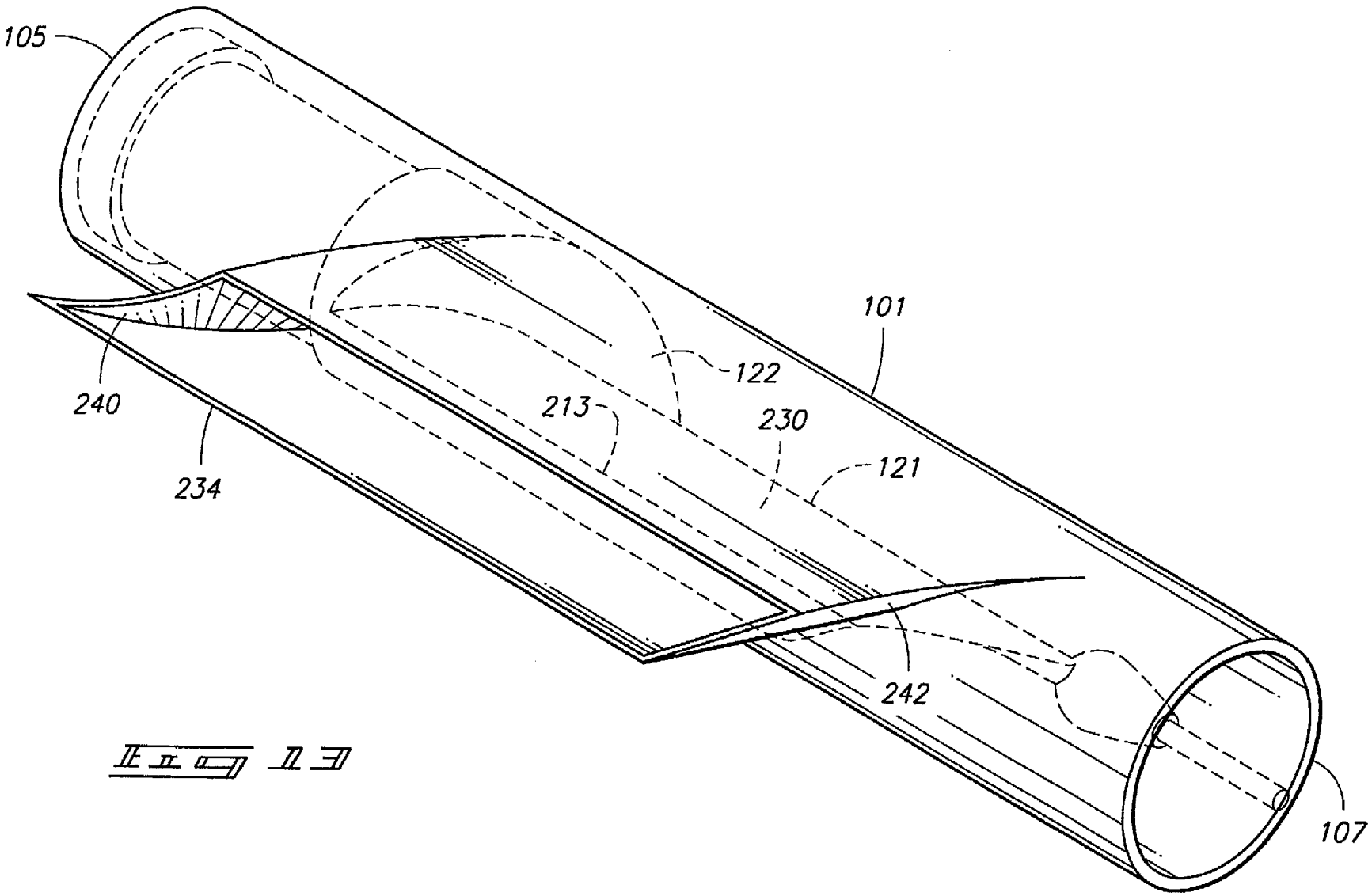

The stationary screw induction system may be used on watercraft having their own propulsion sources as is shown in FIG. 12 where watercraft 20 additionally comprises a separately driven independent propeller 25. In this embodiment where the watercraft has a separate propulsive means the stationary screw induction system described above may be employed. However, in a watercraft not having an independent propulsive means, propulsive means may be added to the stationary screw induction system itself. For watercraft, a typical propulsive system increases the energy in a portion of water proximate to the watercraft by use of a repulsive force generator coupled to the watercraft, thus causing the watercraft to move through the water in response to Newtonian reactive forces. A generic expression for such watercraft propulsive systems may be known as fluid energy stepping devices, because of their common method of operation of step-wise increasing the energy in a portion of fluid, thus creating the reactive force described above. With respect to FIG. 9, a side sectional view of the apparatus of the invention is shown with the additional feature of a fluid energy stepping device. In FIG. 9 the fluid energy stepping device is the propeller 151. Propeller 151 is mounted to drive shaft 153 which drives the propeller in a rotational motion. An end view of the invention with the propeller 151 is shown in FIG. 7. The drive shaft 153 is fitted internally into spine 121. Drive shaft 153 runs from the point at which it attaches to propeller 151 to a motive source at the opposite end of the induction screw. In FIG. 9 an electric motor 155 which is coupled to drive shaft 153 is the motive source. The electric motor is positioned within the closed space between the induction screw 120 and the first end 105. Although shown as an electric motor, which is the preferred embodiment for applications of the invention to small watercraft, the motive source may be any means of turning a drive shaft.

Further, the drive shaft could be coupled to a gear reduction system located in place of the motor 155. The gear reduction system would then be driven by a motive source, for example a gasoline or diesel engine, or a larger electric motor driven by steam turbines, as may be found on large watercraft such as oil tankers. Although shown as a propeller, the fluid energy stepping device may also be an impeller. When the fluid energy stepping device is an impeller, the nozzle 159 extending beyond the end of housing 101 may be used to achieve the proper fluid dynamics to gain the full benefit of the impeller design. In the preferred embodiment, the propeller 151, or axial impeller, turns in the opposite direction as the swirling direction of water moving through the induction screw system. When propeller 151 is replaced with a centrifugal impeller, the impeller would preferably move in the same direction as the swirling flow of water in the induction screw system.

I have found that by placing a bulb-shaped flow enhancer about the spine approximate to the second end of the housing that improved performance of the stationary screw induction system can be obtained. With respect to FIG. 9, the bulb-shaped flow enhancer 161 is shown disposed about spine 121. The flow enhancer 161 should be placed in the housing such that any fluid energy stepping device such as propeller 151 is disposed between the flow enhancer 161 and the second end 107 of the housing 101.

Figure 6:
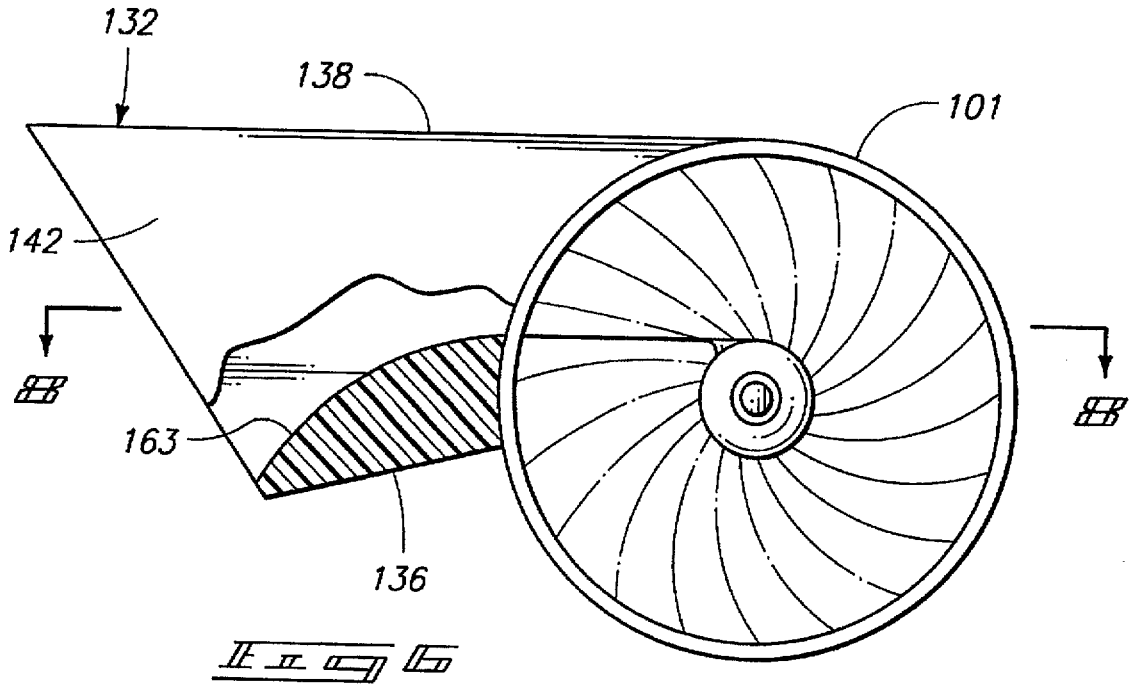
FIG. 6 is a rear view of the apparatus of FIG. 2.
Figure 8:
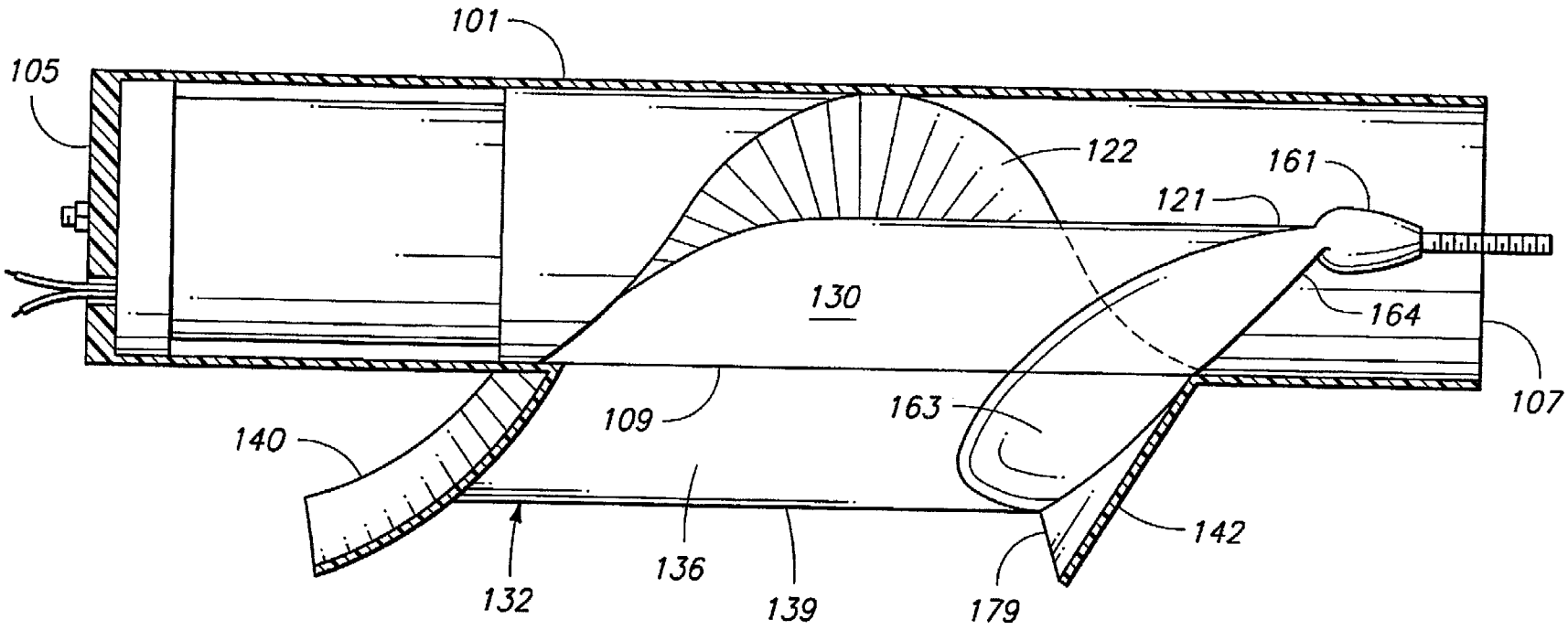
FIG. 8 is a top sectional view of the apparatus shown in FIG. 3.

Turning now to FIG. 8, I have also discovered that a flow ramp 163 disposed within the induction channel 132 proximate to the fourth side 142 of the induction channel and extending to the flow enhancer 161 has a beneficial effect on performance of the stationary screw induction system. The flow ramp 163 is placed on the first side 136 of the induction channel 132 near the induction channel fourth side 142. The flow ramp extends from near the induction inlet 139 to the housing inlet opening 109, across the induction inlet shelf 130, along the spine 121, and finally terminating at flow enhancer 161. The flow ramp 163 is shaped to avoid sharp edge discontinuities in the induction channel 132 where the induction channel enters housing 101 at housing inlet opening 109 proximate to the second end 107. Looking at FIG. 6, the flow ramp 163 is shown disposed within the induction channel 132 proximate to the fourth side 142 of the induction channel. Looking at FIG. 9, it can also be seen that the flow ramp serves an important function in providing additional room for the trailing edge 164 of the helical surface 122 to terminate smoothly into the helical surface central section 123 near the flow enhancer 161.

Referring to FIG. 8, in the preferred embodiment the helical shaped surface 122 terminates near the second end 107 of the housing where the helical surface trailing edge 164 terminates at the flow enhancer 161. In the embodiment where there is no flow enhancer, the helical surface trailing edge 164 terminates at the spine 121.

Referring to FIG. 10, an alternate embodiment of the invention is shown wherein the induction channel 232 has first and second sides 236 and 238 respectively which are arcuate surfaces rather than the essentially planar surfaces described in the preferred embodiment. In the embodiment shown in FIG. 10, induction channel first surface 236 and second surface 238 in the view shown form an essentially horn-shaped funnel which conducts water into housing opening 209. Due to the configuration and location of the modified induction channel 232, fluid enters housing 201 with an imputed swirling motion, which is further enhanced by the helical surface (not shown).

Figure 11:
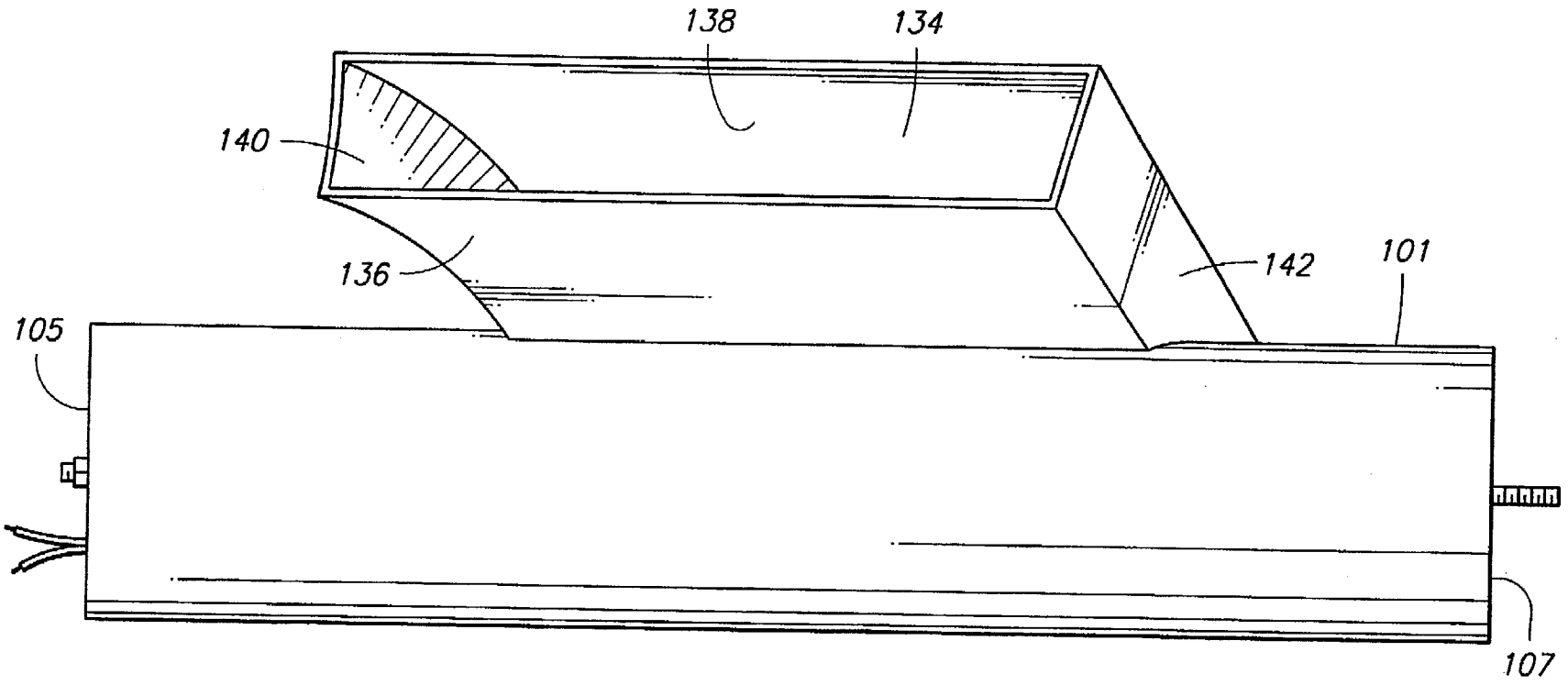
FIG. 11 is an isometric view of an alternative embodiment of the present invention, showing the internal components of the apparatus of FIG. 13.
Figure 11:
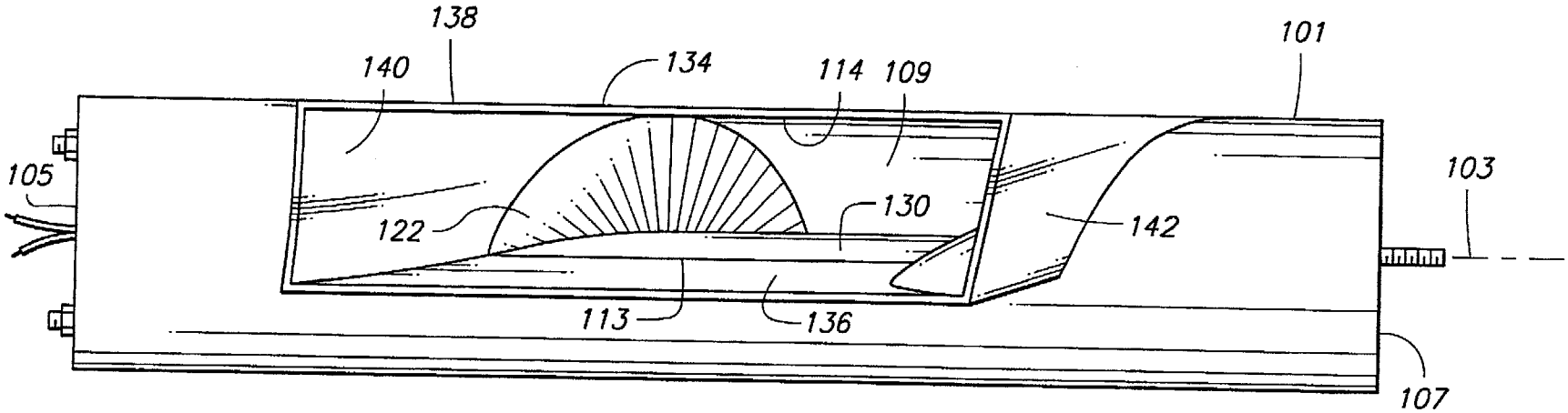

In the embodiment of the invention wherein there is no energy stepping device disposed within the second end 107 when ram pressure is available under the hull of the boat, I have discovered that it may be useful to place angular vanes 252 of FIG. 11 within the housing 101 in end 107. The vanes act to straighten the swirling water being discharged from the stationary screw induction system and provide thrust from the system.

While the description of the present invention describes a single helical surface and a single induction channel, an alternate embodiment of the invention (not shown) utilizes multiple helical surfaces disposed within the housing 101. Water is inducted into each helix by a dedicated induction channel and dedicated housing inlet opening.

FIGS. 11 and 13 show an alternate embodiment of the present invention wherein the helical surface 122 does not terminate at the third side of the induction channel, but instead continues on the same helical curvature such that the third side 240 of the induction channel becomes an extension of the helix, which extends to the outside edge of the inlet channel opening 234. In the apparatus shown in FIG. 11, inlet shelf 230 does not form an essentially flat surface between the inlet opening edge 213 and spine 121, but instead radially curves towards spine 121 as the inlet shelf approaches the spine. The third side 240 of the inlet channel curves away from the fourth side 242 of the inlet channel much more quickly than in the preferred embodiment, as shown more clearly in FIG. 13. Since the inlet shelf 230 does not terminate at the central section of the helical surface 122, it is more appropriate to say that the helical surface 122 continues to the edge 213 of the inlet opening, such that the leading edge of the helix terminates at the edge 213.

Implementation

The apparatus of the invention is applied to watercraft as shown in FIG. 1. Preferably, one stationary screw induction system 10 is placed on the hull 11 on either side of keel 13 of watercraft 20. Induction inlets 134 are positioned such that they are below the water line 30 when the watercraft is placed in a body of water. Preferably the second open end 107 of the screw induction system is positioned such that it is submerged below water line 30, although this is not a necessary requirement. In using the apparatus, propellers 151 are rotated in opposite directions. The initial rotation of propellers 151 causes water to be drawn into the induction inlets 134 and discharged through the second open end 107 of housing 101. As fluid is discharged through opening 107, the watercraft is caused to move forward by the reactional forces operating on the propellers. Once the craft has started to move, water will be induced into the induction openings 134 as a result of the suctional forces provided by the rotation of propellers 151 as well as by induction forces generated by the movement of fluid past induction openings 134.

Although the induction inlet openings 134 are shown directed inwards towards the keel 13 of the watercraft 20 in FIG. 1, in certain applications such as high performance leisure craft it may be desirable to position the induction inlet openings so they are parallel to the water surface and facing downward. This will allow the induction screw system to take advantage of the pressure of water against the hull which is encountered at high speeds, thus acting as a ram injection system to force water into and against surface 122 of the induction screw systems, thus improving performance.

In an alternate embodiment of an application of the invention, two stationary screw induction systems 10 are applied to hull 11 of the watercraft shown in FIG. 12. In this application the watercraft is initially propelled forward by propeller 25. As the watercraft moves through the water, fluid will begin to move through the screw induction system. Fluid moving through the screw induction systems will have a swirling motion imparted to it by nature of the inherent design of the screw induction system. This swirling motion will cause additional fluid to be induced through openings 134 into the housing 101 and discharged through openings 107.

EXAMPLES

In one example two stationary screw induction systems were placed on the hull of a canoe in a configuration similar to that shown in FIG. 1. The stationary screw induction systems were driven by electric motors disposed within the first end of housings 101 in a manner similar to that shown in FIG. 9. The battery was connected to an ammeter to measure the electrical current supplied to the motors at any given time. The watercraft was further fitted with instrumentation to measure the speed of the craft in the water at any given time. At a speed of 3.8 miles per hour, the stationary screw induction systems drew a constant load of 12 amps. The canoe was then fitted with a Minn-Kota electric trolling motor which is propeller driven. The trolling motor was driven by the same 12 volt battery used to drive the stationary screw induction systems. At the same speed of 3.8 mph, the Minn-Kota motor drew a constant load of 19.5 amps.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A stationary screw induction system for a watercraft, comprising:

an elongated housing defining a void and having a central axis, a first closed end, a second open end, an inner surface and an outer surface, and a housing inlet opening disposed within said housing between said first end and said second end, said housing inlet opening having at least one defined edge;

an induction screw comprising an essentially helical shaped surface disposed within said housing, said helical surface being radially disposed about said housing central axis, said helical surface having a leading edge in contact with said housing opening at least one defined edge and an outside edge in contact with the inner surface of said housing; and an induction channel having a first end and a second end, said induction channel first end being in fluid communication with said housing inlet opening, said induction channel second end being an open induction inlet, said induction channel further comprising a first side disposed between said induction inlet and said at least one defined edge, and a second side tangential to said housing;

wherein said first and said second induction channel sides each comprise a leading edge proximate to said housing first end, and a trailing edge proximate to said housing second end;

said induction channel further comprising a third side and a fourth side, said third side disposed between said first side leading edge and second side leading edge, said fourth side disposed between said first side trailing edge and second side trailing edge, said third and fourth sides intersecting said housing at angles such that said third side slants towards said second end of said housing as said third and said fourth sides approach said housing; and wherein said induction channel third side curves away from said induction channel fourth side as said third side approaches said induction inlet at said induction channel first side.

2. A stationary screw induction system for a watercraft, comprising: a cylindrical housing defining a void and having a central axis, a first closed end, a second open end, an inner surface and an outer surface, and a housing inlet opening disposed within said housing between said first end and said second end, said housing inlet opening having at least one essentially straight edge;

an induction screw comprising a helical shaped surface disposed within said housing, said helical surface being radially disposed about a spine coincident with said housing central axis, said helical surface having a central section in contact with said spine and an outside edge in contact with the inner surface of said housing;

an induction channel having a first end and a second end, said induction channel first end being in fluid communication with said housing inlet opening, said induction channel second end being an open induction inlet; and an induction inlet shelf disposed between said essentially straight edge of said housing inlet opening and said helical surface central section.

3. The stationary screw induction system of claim 2 wherein said induction channel further comprises a first side disposed between said induction inlet opening and said housing opening essentially straight edge, and a second side tangential to said housing.

4. The stationary screw induction system of claim 3 wherein said induction channel first side and said induction shelf lie in essentially the same plane.

5. The stationary screw induction system of claim 4 wherein said induction channel first side and said induction channel second side converge as they approach said inlet opening.

6. The stationary screw induction system of claim 4 wherein said induction channel first side is essentially parallel to said induction channel second side.

7. The stationary screw induction system of claim 3 wherein said first and said second induction channel sides each comprise a leading edge proximate to said housing first end, and a trailing edge proximate to said housing second end, said induction channel further comprising a third side and a fourth side, said third side disposed between said induction channel first side and second side leading edges, said fourth side disposed between said induction channel first side and second side trailing edges, said third and fourth sides intersecting said housing at angles such that said third side slants towards said second end of said housing as said third and fourth sides approach said housing.

8. The stationary screw induction system of claim 7 wherein said induction channel third side curves away from said induction channel fourth side as said third side approaches said induction inlet at said induction channel first side.

9. The stationary screw induction system of claim 2 further comprising straightening vanes disposed within said second end of said housing.

10. The stationary screw induction system of claim 2 further comprising a fluid energy stepping device disposed within said second end of said housing.

11. The stationary screw induction system of claim 8 wherein said energy stepping device is a propeller, said propeller being driven by drive shaft disposed within said spine.

12. The stationary screw induction system of claim 8 wherein said energy stepping device is an impeller, said impeller being driven by drive shaft disposed within said spine.

13. The stationary screw induction system of claim 2 further comprising a bulb-shaped flow enhancer disposed about said spine proximate to said second end of said housing, and wherein said helical surface terminates in a trailing edge at said flow enhancer.

14. The stationary screw induction system of claim 11 further comprising:

a fluid energy stepping device interposed at least partially within said housing between said flow enhancer and said second end of said housing.

* * * * *